US005809598A

United States Patent [19]

Duvivier

[11] Patent Number: 5,809,598

[45] Date of Patent: Sep. 22, 1998

[54] DEVICE FOR SANITARY TREATING A SLEEPING MATTRESS

[75] Inventor: Jean-Marie Duvivier, Payroux, France

[73] Assignee: Literie Duvivier, Jousse, France

[21] Appl. No.: 836,918

[22] PCT Filed: Nov. 23, 1995

[86] PCT No.: PCT/FR95/01551

§ 371 Date: May 23, 1997

§ 102(e) Date: May 23, 1997

[87] PCT Pub. No.: WO96/15698

PCT Pub. Date: May 30, 1996

[30] Foreign Application Priority Data

Nov. 23, 1994 [FR] France ..... 94 14408

[51] Int. Cl.[6] ..... A47C 31/00; B01J 19/00

[52] U.S. Cl. ..... 5/658; 5/724; 5/694; 422/291

[58] Field of Search ..... 422/291; 5/690, 5/694, 704, 724, 726, 652.1, 658

[56] References Cited

U.S. PATENT DOCUMENTS

| | | | |
|---|---|---|---|
| 934,465 | 9/1909 | Ruet | 5/652.1 |
| 953,551 | 3/1910 | Quick | 5/724 |
| 2,712,656 | 7/1955 | Radzik | 5/724 |
| 2,766,465 | 10/1956 | Radzik | 5/724 |
| 3,101,988 | 8/1963 | Peebles | 5/724 |

FOREIGN PATENT DOCUMENTS

| | | |
|---|---|---|
| 2692768 | 6/1992 | France . |
| 498806 | 6/1936 | United Kingdom . |
| 791017 | 2/1958 | United Kingdom . |

*Primary Examiner*—Michael F. Trettel
*Attorney, Agent, or Firm*—Young & Thompson

[57] ABSTRACT

A device for sanitary treating a sleeping mattress and more particularly a spring mattress and including an internal free volume (18) delimited by upper (12) and lower (14) faces and by a peripheral lateral strip (16). The springs (20) are disposed in the free volume. Ventilation structure is fitted with lateral strips. An injection device (24) injects a treatment gas (25) in the form of a powder or gas contained in a receptacle (26) with a propulsion device (28) of a treatment agent and an injection head (30).

9 Claims, 2 Drawing Sheets

DEVICE FOR SANITARY TREATING A SLEEPING MATTRESS

Figure 1:
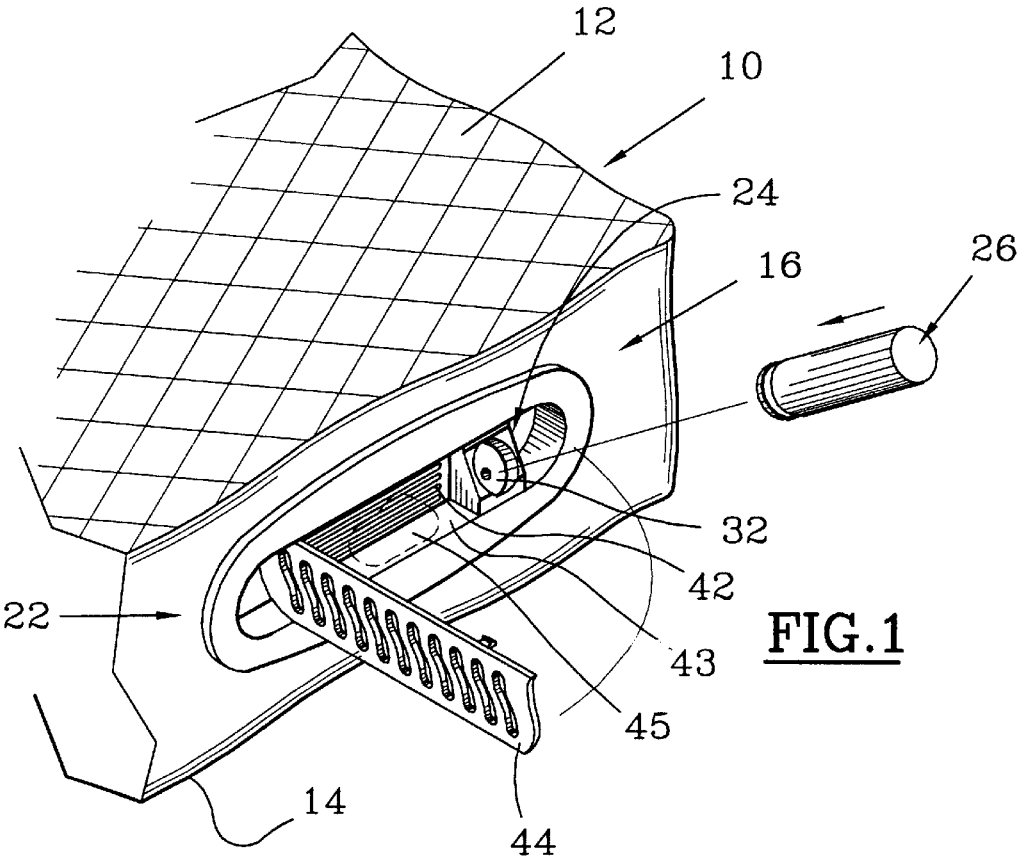

The present invention concerns a device for pesticide-treating a sleeping mattress having a free internal space and in particular a spring mattress.

The French patent FR-A-92 07870 in the name of the Applicant refers to a mattress equipped with means for diffusing pesticide products and/or odorous products appearing in a solid form by insetting a cassette placed on the portion of the mattress containing these solid products.

The air, circulating from the outside of the mattress towards the inside, favours the sublimation of the pesticide and/or odorous products, whilst ensuring a continuous treatment of the inside of the mattress.

If this disposition may be satisfactory, the production of the solid products poses several problems and in particular certain products may be impossible to solidify or their sublimation speed may be uncontrollable.

In all cases, dosing is delicate as it varies considerably according to the temperature and hygrometric conditions. Moreover, certain products are permitted in the form of a periodic local treatment but are prohibited in a small continuous dose.

The present invention concerns a simple device which is permanently fixed on the lateral strip of the mattress and which simultaneously ensures ventilation and treatment by pesticides, that is by insecticides/bactericides and fungicides, which enables all powdered or gaseous products to be introduced, which uses under pressure gas-propellant receptacles or manual pressure ejection receptacles, which ensures a good diffusion of the treatment agent inside the free internal space according to the treatment agent, and which is small since it only uses static elements for diffusion, which permits the choice of agents and the periodicity of treatments.

To this effect, the device of the invention for the sanitary treatment of a sleeping mattress and more particularly a spring mattress, including a free internal volume delimited by the upper and lower faces and a peripheral lateral strip, the springs being disposed in said free volume, as well as ventilation means fitted in the lateral strips, is characterised in that it includes means for injecting under pressure a treatment gas in the form of a powder or gas contained in a receptacle with means for propelling said treatment agent and a distribution head.

More specifically, the injection means include at least one base integral with the lateral strip provided with at least one injection housing for receiving the distribution head and means for diffusing the treatment agent in the free space.

These diffusion means include a common diffusion channel with a length exceeding the thickness of the lateral strip so as to open into the free space.

According to one particular characteristic of the invention, the diffusion channel includes diffusion orifices whose number and orientation depends on the physico-chemical parameters of the treatment agent.

In addition, the base includes static ventilation means disposed immediately close to the injection housing.

This base includes a movable ventilation, flap covering the static ventilation means and the injection housing.

The housing between the static grill and the mobile flap is provided to receive a product in a bag.

Figure 2:
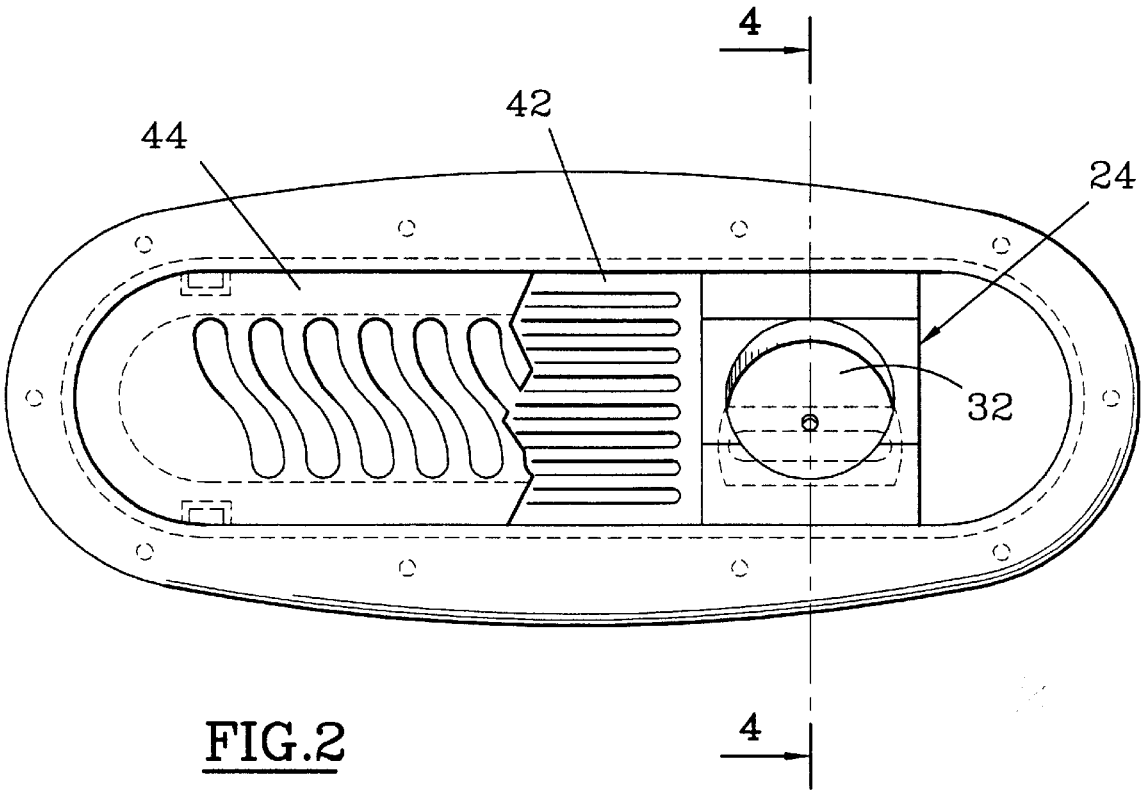
Figure 3:
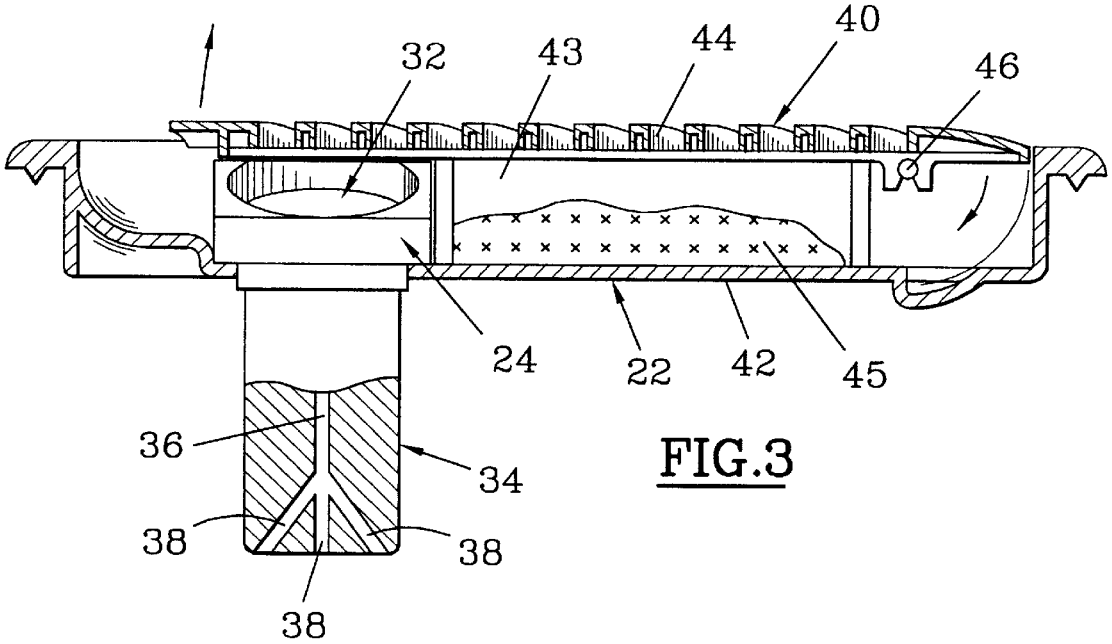
Figure 4:
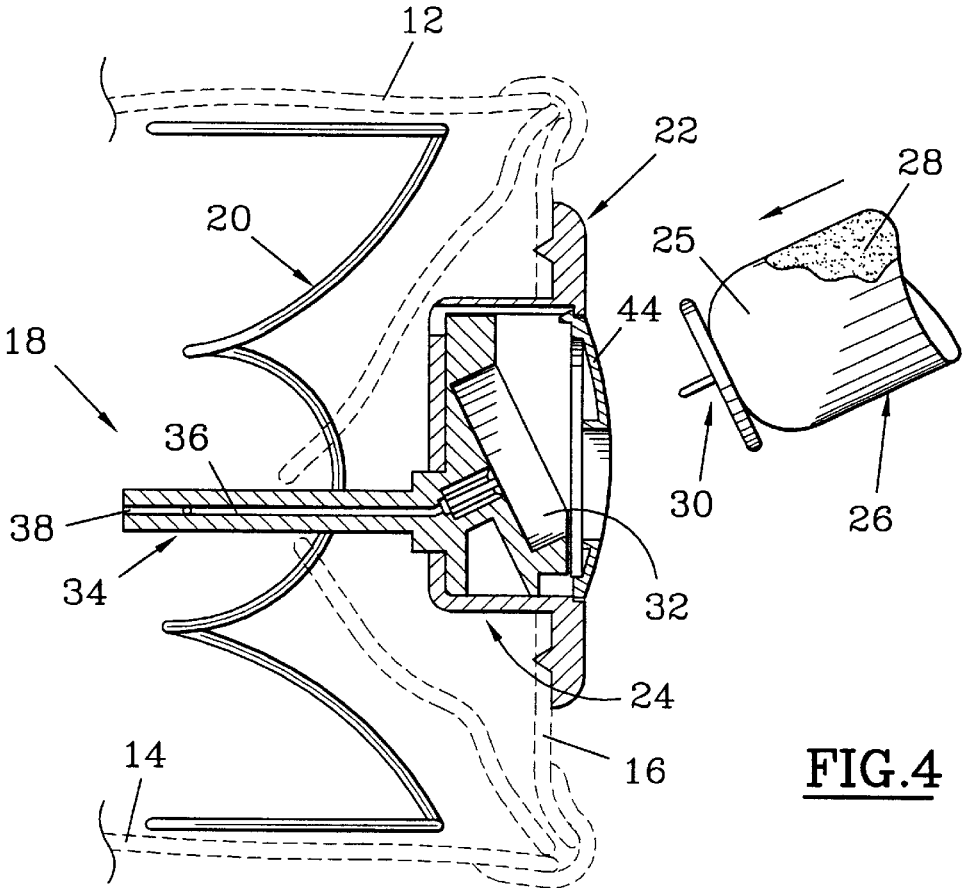

The present invention is described hereafter according to a preferred non-restrictive embodiment with reference to the accompanying drawings which represent on the various figures:

FIG. 1, a perspective view of a mattress portion equipped with a base according to the invention with a receptacle containing the treatment agent, FIG. 2 is a front view of the base of the device of the invention, FIG. 3 is a cutaway view by a median horizontal plane of FIG. 2, and FIG. 4 is a cutaway view by a vertical plane along the line 4—4 of FIG. 2.

FIG. 1 shows at 10 the mattress including a top 12, a bottom 14 and a lateral strip 16 which delimits an internal free space 18 visible on FIG. 4. It is to be noted that this space is solely occupied in an extremely limited way by the springs, one copy 18 being diagramatically drawn.

A base 22 is secured to the lateral strip 16. It includes under pressure means 24 for injecting a treatment agent 25 in the form of a gas or powder contained in a receptacle 26 with means 28 for propelling the treatment agent and a distribution head 30 (see FIG. 4).

The shape of the distribution head 30 is compatible with the injection housing 32 and is extended by diffusion means 34 with a common channel 36 which opens into the internal free space 18 and diffusion orifices 38 whose diameter and number depend on the physico-chemical parameters of the treatment agent 25 and possibly the configuration of the internal space 18 (see FIG. 3).

The base 22 further includes static ventilation means 40. These means include a first fixed grill 42 and a mobile ventilation flap 44 covering the static ventilation means and the injection housing 32 (see FIG. 2). This flap 44 is mounted pivoting around a spindle 46 and a boss 48 receives the out-of-line end 50 of the mobile flap 44.

There is a housing 43 disposed between the static grill 42 and the mobile flap 44. This housing may receive a product packed in a bag with the reference 45 and more particularly a hygroscopic material, thus forming a drying agent.

The functioning of the device of the invention is now to be described as follows.

The drying agent is permanently in place and functions continuously. It merely suffices for the user to anticipate a periodic change of the bag containing the hygroscopmic product so as to maintain the drying performances.

The user wishes to carry out a periodic treatment, either seasonal or for convenience, with an acaricide product, for example, at the onset of winter.

To this effect, he opens the flap 44 by making it pivot around its axis 46, as shown on FIG. 1. He introduces the injection head 30 of the under pressure receptacle into the injection housing 32 adjusts to this effect to avoid leaks, and then via pressure on the receptacle, he triggers an injection of the acaricide treatment agent 25 which passes through the central channel 36 and diffuses through the orifices 38 in the internal free space 18. According to the instructions of the manufacturer, the user exerts pressure one or more times lasting one or several seconds.

The fact that the housing 32 is slanted allows for a correct functioning of the head and the under pressure receptacle, thus avoiding any ill-timed draining of said receptacle if it needed to be held horizontally.

The air contained in the mattress is raised to excess pressure by injecting the treatment agent and propulsive gas and is evacuated through the fixed grill 42.

Thus, a significant concentrated dose of the product invades the internal space, thus providing the treatment with a certain effectiveness, also reinforced by a suitably-adapted diffusion.

The user removes the receptacle and places it in a safe location out of the range of children, this aspect proving to be a significant additional advantage.

The user closes the mobile flap so as to create a ventilation chicane with the first grill, whilst protecting the injection housing.

It shall be observed that there is no residue following the treatment and thus no risk of soiling and more generally staining the mattress.

The receptacles are well-known in industrial applications and can be produced easily.

They may be sold by particular networks, and in certain cases for products strictly linked to pharmacopoeia, they may be distributed exclusively in specialised dispensaries, such as chemists.

It is also possible to provide manual activation injection means in the form of pulverising flasks with treatment agent refills.

Similarly, the base may include several distinct housings with polarising slots, each housing being adapted for a particular treatment agent. Thus, it is possible to diffuse odorous products, such as perfumes, by one of the housings, and bactericide products by another housing.

It is also possible to provide bases with different housing orientations for each base. Thus, for example, a first base has a housing slanted downwards, as described earlier, and a second base has a housing slanted upwards.

In the embodiment, the pieces have been moulded from an adapted plastic material so as to avoid condensation at the time of injection. To this effect, the central channel could be slightly slanted towards the lower face of the mattress, which avoids dripping of the diffused products.

I claim:

1. A device for sanitary treating a sleeping mattress and more particularly a spring mattress and including an internal free volume (18) delimited by upper (12) and lower (14) faces and by a peripheral lateral strip (16), the springs (20) being disposed in said free volume, as well as ventilation means fitted with lateral strips, wherein it includes injection means (24) for injecting a treatment gas (25) in the form of a powder or gas contained in a receptacle (26) with propulsion means (28) of a treatment agent and an injection head (30).

2. Treatment device according to claim 1, wherein the injection means (24) include at least one base (22) integral with the lateral strip (16) fitted with at least one injection housing (32) for receiving the injection head (30) and diffusion means (34) of the treatment agent in the free volume (18).

3. Treatment device according to claim 2, wherein the diffusion means (34) include a common diffusion channel (36) whose length is larger than the thickness of the lateral strip so as to open into the free space.

4. Treatment device according to claim 3, wherein the diffusion channel (36) includes diffusion orifices (38).

5. Treatment device according to claim 2, wherein the base (22) includes static ventilation means disposed immediately close to the injection housing.

6. Treatment device according to claim 2, wherein the base includes a mobile ventilation flap (44) covering the static ventilation means and the injection housing.

7. Treatment device according to claim 5, which further includes a housing (43) between a static grill (42) and a mobile flap (44) and provided to receive a product in a bag (45).

8. Treatment device according to claim 5, wherein the base includes a mobile ventilation flap (44) covering the static ventilation means and the injection housing.

9. Treatment device according to claim 6, wherein includes a housing (43) between a static grill (42) and a mobile flap (44) and provided to receive a product in a bag (45).

* * * * *